United States Patent [19]

Fujimura et al.

[11] Patent Number: 4,554,173

[45] Date of Patent: Nov. 19, 1985

[54] METHOD FOR MANUFACTURING FLAME-RETARDANT INSULATED WIRE AND CABLE FOR NUCLEAR POWER STATIONS

[75] Inventors: Syunichi Fujimura, Chigasaki; Eisuke Oda, Yokohama; Miyuki Hagiwara, Maebashi; Youske Morita, Takasaki, all of Japan

[73] Assignees: The Furukawa Electric Co., Ltd.; Japan Atomic Energy Research Institute, both of Tokyo, Japan

[21] Appl. No.: 521,115

[22] Filed: Aug. 8, 1983

[30] Foreign Application Priority Data

Aug. 13, 1982 [JP] Japan ..... 57-139680

[51] Int. Cl.[4] ..... B05D 5/12

[52] U.S. Cl. ..... 427/120; 427/388.2; 427/388.5; 427/398.4; 264/174

[58] Field of Search ..... 427/120, 388.2, 388.5, 427/398.4; 428/378; 264/174

[56] References Cited

U.S. PATENT DOCUMENTS 3,936,523 2/1976 Kleeberg et al. ..... 525/324 X 4,373,046 2/1983 Hagiwara et al. ..... 524/285

FOREIGN PATENT DOCUMENTS 56-135510 10/1981 Japan .

*Primary Examiner*—Michael R. Lusignan

*Assistant Examiner*—Ken Jaconetty

*Attorney, Agent, or Firm*—Frishauf, Holtz, Goodman & Woodward

[57] ABSTRACT

A method for manufacturing a flame-retardant insulated wire and cable for use in nuclear power stations, comprises the steps of: extruding on a conductor or cable care to a predetermined thickness a composition consisting of 100 parts by weight of a basic polymer such as a thermoplastic resin or a rubber which can be crosslinked by an organic peroxide-based crosslinking agent, at least 10 parts by weight of a halogenated acenaphthylene or a condensate thereof, and 0.5 to 10 parts by weight of an organic peroxide; and heating a resultant wire or cable for crosslinking in the absence of water and at a temperature higher than the decomposition temperature of the organic peroxide.

18 Claims, 2 Drawing Figures

METHOD FOR MANUFACTURING FLAME-RETARDANT INSULATED WIRE AND CABLE FOR NUCLEAR POWER STATIONS

BACKGROUND OF THE INVENTION

The present invention relates to a method for manufacturing a flame-retardant insulated wire and cable for use in nuclear power stations, which has excellent mechanical properties and environmental resistance.

An insulated wire and cable for use in nuclear power stations must satisfy strict requirements. That is, the cable is first subjected to a series of environmental tests such as aging, irradiation, and simulated loss of coolant accident (LOCA). Then, the cable must also pass a withstand voltage test. Moreover, the wire and cable must also pass a vertical tray flame test of cable and a vertical flame test of wire as defined by IEEE Std., 383 (1974).

In the manufacture of a flame-retardant insulated wire and cable, a thermoplastic resin or rubber composition containing hexabromobenzene, decabromodiphenyl ether, perchloropentacyclodecane or the like is known to be used as the rubber or plastic composition for insulation or jacket. In order to improve heat resistance, a method is known for performing crosslinking by a peroxide or by an electron beam.

However, an insulated layer and jacketed layer containing a flame retardant has inferior mechanical properties after irradiation in such environmental tests as described above. For example, an insulated wire, when wound around a mandrel having the same diameter, cracks in its insulating layer.

The present inventors have previously found that a rubber or plastic composition containing a halogenated acenaphthylene or a condensate thereof exhibits excellent environmental resistances such as flame retardancy and irradiation resistance. The present inventors have filed a patent application based on this finding (U.S. Pat. No. 4,373,046).

The present inventors have continued their studies to develop flame-retardant, crosslinked rubber or plastic insulated wires and cables using such a flame-retardant rubber or plastic composition. As a result of such studies, it has been found that a flame-resistant, crosslinked rubber or plastic insulated wire and cable manufactured according to the above-mentioned patent encounters a subsequent problem if it is subjected to the environmental tests required for use in nuclear power stations. More specifically, the present inventors prepared flame-resistant, crosslinked rubber or plastic insulated wires and cables by performing a most conventional crosslinking method, i.e., steam continuous crosslinking of a flame-retardant rubber or plastic composition containing the halogenated acenaphthylene or a condensate thereof as a flame retardant and an organic peroxide as a crosslinking agent, so as to obtain an insulation with excellent heat resistance and mechanical properties. When these wires and cables were subjected to the environmental tests required for use in nuclear power stations, they did not pass the subsequent withstand voltage test since the dielectric withstand characteristics were abruptly degraded after the environmental tests.

Generally known methods for improving water resistance of insulated wires and cables, are to use a polymer having a high water resistance, to improve the crosslinking density of the resin, to add a hydrophobic treatment agent such as a silicone coupling agent to the resin, and so on. Although each of these methods provides some slight improvement in water resistance, the wires and cables prepared by these methods did not pass the withstand voltage test.

However, the rubber or plastic composition itself, as a major constituent of the insulation, has characteristics which enable it to pass the withstand voltage test even if the wire and cable has degraded dielectric withstand characteristics following the environmental tests. Thus, it is considered that such degradation in dielectric withstand characteristics is attributable to the halogenated acenaphthylene or a condensate thereof used as a flame retardant. It was also found that a flame-retardant, crosslinked rubber or plastic insulated wire and cable containing a halogenated acenaphthylene or a condensate thereof has a problem of swelling which results in a significant increase in the outer diameter of the cable after the environmental tests. In order to provide a solution to the above-mentioned problem, the present inventors have made further studies. As a result of such studies, they have reached the conclusion that the degradation in the dielectric withstand characteristics of the wire and cable is due to some reaction during the environmental tests between a small amount of impurities contained in the halogenated acenaphthylene and steam to which the cable is exposed.

Further, it has been found that this problem can be solved by eliminating moisture from a heating atmosphere for crosslinking an insulating layer consisting of the rubber or plastic composition. The present invention has been established by this finding.

SUMMARY OF THE INVENTION

It is an object of the present invention to provide a method for manufacturing a flame-retardant insulated wire and cable for use in nuclear power stations, which has excellent mechanical properties and environmental resistance.

There is provided according to the present invention a method for manufacturing a flame-retardant insulated wire and cable for nuclear power stations, comprising the steps of: extruding on a conductor or a cable core to a predetermined thickness a composition consisting of 100 parts by weight of a basic polymer such as a thermoplastic resin or a rubber which can be crosslinked by an organic peroxide-based crosslinking agent, at least 10 parts by weight of a halogenated acenaphthylene or a condensate thereof, and 0.5 to 10 parts by weight of an organic peroxide; and heating a resultant wire and cable for crosslinking in the absence of water and at a temperature higher than a decomposition temperature of the organic peroxide by a heating means selected from a melted salt bath, an inert gas bath, infrared heating and the like.

DETAILED DESCRIPTION OF THE PREFERRED EMBODIMENTS

Figure 1:
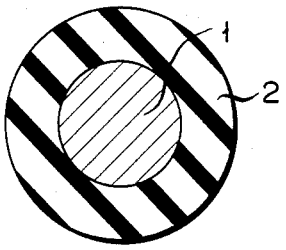
FIGS. 1 and 2 are sectional views of a wire and cable obtained by a method according to an embodiment of the present invention.

Thermoplastic resins to be used herein may be polyethylene, ethylene-vinyl acetate copolymer, ethylene-propylene copolymer, ethylene-ethyl acrylate copolymer, ethylene-vinyl acetate-grafted vinyl chloride terpolymer and the like. Rubbers to be used herein may be ethylene-propylene-diene terpolymer, ethylene-propylene-ethylidene norbornene terpolymer and the like. These thermoplastic resins and rubbers contain ethylene, α-olefin, diene and the like as their major constituents and are crosslinked to be gelled by an organic peroxide-based crosslinking agent to be described later.

The halogenated acenaphthylene to be used herein has the general formula:

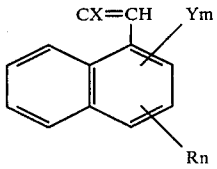

(where X is a hydrogen, chlorine or bromine atom; Y is a chlorine or bromine atom; R is a substituting group other than a halogen atom; and m is an integer within the range of 2 to 6 and n is an integer within the range of 0 to 4, m and n being in a relationship expressed by $m+n \leqq 6$, and R being the same or different when $n \geqq 2$) and a condensate to be used herein is a condensate of the halogenated acenaphthylene having the above-mentioned general formula, which is obtained by condensation using the dehydration or dehydrohalogenation reaction to have a degree of condensation of 2 or more.

The bonds between the halogenated acenaphthylene units which may be easily formed may include:

1 (or 2), 5'-( 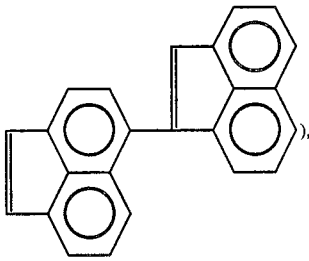 ), 1 (or 2), 6'-( 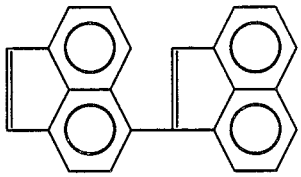 ), 4,4' (or 4,7', 7,7')-( 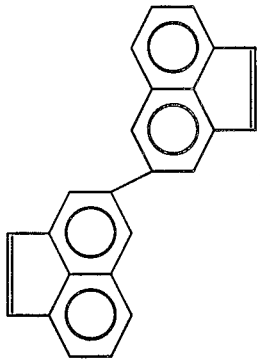 ), -continued 4,5' (or 4,6', 5,7')-( 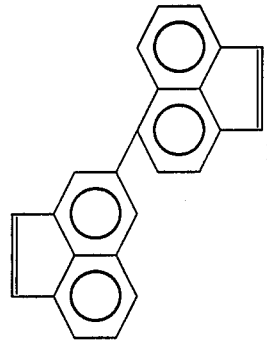 ), 5,5' (or 5,6')-( 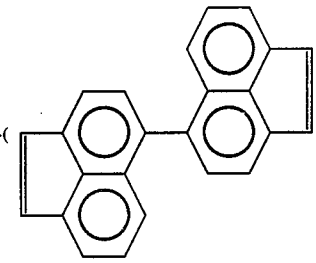 )

and the like. A condensate having a degree of condensation of 3 or more may be considered to be obtained by increasing the number of units by means of one of the bonds as enumerated above. When the degree of condensation exceeds 10, dispersibility of the condensate in the composition is undesirably impaired. Chlorine and bromine are the most preferred substances to be contained in the halogenated acenaphthylene since they have superior flame retardant properties compared with other substances.

The halogenated acenaphthylene is added in the composition of the present invention in the amount of 10 parts by weight or more, and preferably 15 to 45 parts by weight, based on 100 parts by weight of the basic polymer such as one of the thermoplastic resins as enumerated above. This is because if the amount of the halogenated acenaphthylene is less than 10 parts by weight, it cannot provide sufficient flame retardancy required for insulated wires and cables used for power distribution in nuclear related facilities such as nuclear power stations or reprocessing facilities.

Although combination of the halogenated acenaphthylene with another flame retardant may improve flame retardancy of the wire and cable, it may also cause degradation in other properties of the wire and cable such as tensile strength. If an additional flame retardant is to be used, it is preferably used in an amount equal to or less than that of the halogenated acenaphthylene.

The organic peroxide to be used herein may be dicumyl peroxide, 1,3-bis(t-butyl peroxyisopropyl)benzene, 2,5-dimethyl-2,5-di(t-butyl peroxy)hexyne-3,t-butyl cumyl peroxide and so on. The organic peroxide is added in the amount of 0.5 to 10 parts by weight based on 100 parts by weight of the basic polymer. The organic peroxide must be contained in this amount so as to crosslink the basic polymer and to impart the desired mechanical properties and resistance to thermal deformation to the crosslinked composition.

The composition of the present invention is preferably prepared by a conventional mixing method. Alternatively, the composition may be obtained by preparing a mixture containing a high-concentration halogenated acenaphthylene or a condensate thereof and then mixing it with the basic polymer so as to obtain a wire and cable with improved performance. An extruder for extruding the composition on a conductor or a cable core is not particularly limited. However, an extruder connected to a crosslinking apparatus will result in the manufacture of wires and cables having better properties.

According to the method of the present invention, crosslinking in the absence of water includes all crosslinking methods executed in the absence of water and excludes any crosslinking method executed in the presence of water such as steam crosslinking. More specifically, the crosslinking method according to the present invention may be any of or a combination of a method for passing the composition through a heated atmosphere of a non-oxidizing inert gas such as nitrogen or carbon dioxide gas, a method for passing the composition through a bath such as a melted salt bath mainly consisting of high-temperature sodium nitrate, potassium nitrate or sodium nitrite, a Wood's metal bath or a liquid paraffin bath, a method for passing the composition along a heating metal pipe having an inner diameter corresponding to the outer diameter of the wire and cable with application of a lubricant as needed, and a method for heating such as radio heating, microwave heating, infrared heating and fluidized bed heating.

The insulated wire obtained in this manner is covered with a protective jacket, or a plurality of such wires are interwoven and the resultant cable core is covered with a protective jacket for prevention of damage.

Regarding the crosslinking method used for the jacket, a crosslinked plastic or rubber is used for the jacket to obtain good mechanical and thermal properties. When a jacket of a crosslinked plastic or vulcanized rubber is formed, one of the crosslinking methods as enumerated above is preferably adopted.

The material of the jacket may be chlorosulfonated polyethylene, chloroprene rubber and the like. In particular, chlorosulfonated polyethylene has excellent irradiation resistance, water resistance and flame retardance, and is therefore particularly suitable for the purpose of the present invention.

Figure 2:
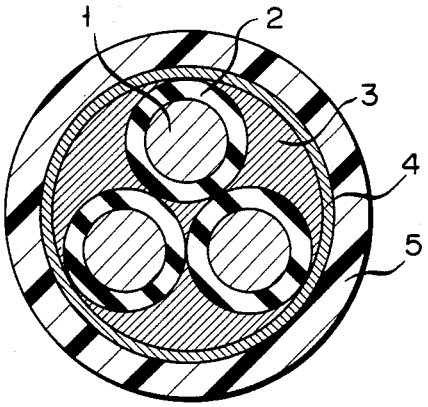

FIGS. 1 and 2 are sectional views of a wire and cable prepared by a method according to an embodiment of the present invention. Referred to FIGS. 1 and 2, reference numeral 1 denotes a conductor; 2, an insulating layer consisting of a flame-retardant crosslinked rubber or plastics; 3, a filler; 4, a tape, and 5, a protective jacket.

As is apparent from the above description and an Example to be described later, a halogenated acenaphthylene is used as a flame retardant and crosslinking is performed in the absence of water to manufacture a flame-retardant insulated wire or cable for use in nuclear power stations. Accordingly, a flame-retardant insulated wire and cable is obtained which is capable of withstanding severe environmental test encountered at nuclear power stations and the like, and which also satisfies other requirements regarding electrical and mechanical properties. Therefore, the industrial applicability of the method of the present invention is significant.

The present invention will now be described by way of its Examples.

EXAMPLES 1-6 AND COMPARATIVE EXAMPLES 1-3

As illustrated in FIG. 1, a composition shown in Table 1 below was extruded to a thickness of 1.0 mm on a tin-plated soft copper stranded wire (5.5 mm outer diameter; 8 $mm^2$ sectional area). Continuous crosslinking under the conditions given in Table 1 was performed to provide a flame-retardant wire insulated with an ethylene-propylene-diene terpolymer.

Table 2 below shows the original properties, the properties after irradiation and the properties after other environmental tests (see Note) of the obtained insulated wire.

TABLE 1

| | | Example | | | | | | Comparative Example | | |
|---|---|---|---|---|---|---|---|---|---|---|
| | | 1 | 2 | 3 | 4 | 5 | 6 | 1 | 2 | 3 |
| Composition (parts per hundred resin) | Ethylene-propylene-diene terpolymer (1) | 100 | 100 | 100 | 100 | 100 | 100 | 100 | 100 | 100 |
| | "Nocrac-224" (2) | 1.5 | 1.5 | 1.5 | 1.5 | 1.5 | 1.5 | 1.5 | 1.5 | 1.5 |
| | Stearic acid | 1 | 1 | 1 | 1 | 1 | 1 | 1 | 1 | 1 |
| | Sulfur | 0.4 | 0.4 | 0.4 | 0.4 | 0.4 | 0.4 | 0.4 | 0.4 | 0.4 |
| | Zinc oxide | 5 | 5 | 5 | 5 | 5 | 5 | 5 | 5 | 5 |
| | Talc | 100 | 100 | 100 | 100 | 100 | 100 | 100 | 100 | 100 |
| | Dicumyl peroxide | 3 | 3 | 3 | 3 | 3 | 3 | 3 | 3 | 3 |
| | 3,5,6,8-tetrabromoacenaphthylene | 30 | 25 | | | | | | | |
| | Condensed brominated acenaphthylene (3) | | | 30 | 15 | 45 | 30 | 30 | | |
| | Decabromodiphenyl ether | | 5 | | 15 | | | | 30 | 30 |
| | Antimony trioxide | 10 | 10 | 10 | 10 | 20 | 10 | 10 | 15 | 15 |
| Cross-linking condition | Heating method | Melted salt (4) | Melted salt (4) | Melted salt (4) | Melted salt (4) | Melted salt (4) | Nitrogen gas (5) | Steam (6) | Steam (6) | Melted salt (4) |

Note:
(1) "EP-21" (propylene content: 40% by weight) available from Japan ynthetic Rubber Co., Ltd.
(2) 2,2,4-trimethyl-1,2-dihydroquinoline copolymer available from Ouchi Shinko Chemical Co., Ltd.
(3) Degree of condensation: 2 to 5, Br content: 61%
(4) Temp.: 200° C., $N_2$ gas pressure: 3 $kg/cm^2$, heating medium: an inorganic salt consisting mainly of sodium nitrate, potassium nitrate and sodium nitrite and having a melting point of 142° C.
(5) Crosslinking pipe temp.: 200° C., $N_2$ gas pressure: 5 $kg/cm^2$
(6) Temp.: 190° C., pressure: 12 $kg/cm^2$

TABLE 2

| | | Example | | | | | | Comparative Example | | |
|---|---|---|---|---|---|---|---|---|---|---|
| | | 1 | 2 | 3 | 4 | 5 | 6 | 1 | 2 | 3 |
| Original | Mechanical property (1) | | | | | | | | | |
| | Tensile strength ($kg/mm^2$) | 0.82 | 0.83 | 0.65 | 0.63 | 0.61 | 0.59 | 0.65 | 0.62 | 0.63 |
| | Elongation (%) | 480 | 480 | 470 | 500 | 430 | 450 | 500 | 510 | 500 |
| | Breakdown voltage (kV) (2) | 33 | 33 | 30 | 28 | 33 | 30 | 30 | 28 | 28 |
| After irradiation (3) | Mechanical property | | | | | | | | | |
| | Tensile strength ($kg/mm^2$) | 0.75 | 0.74 | 0.60 | 0.58 | 0.62 | 0.57 | 0.60 | 0.37 | 0.38 |
| | Elongation (%) | 120 | 110 | 120 | 90 | 120 | 120 | 120 | 30 | 30 |
| | Breakage after winding around mandrel having diameter equal to its diameter | Absent | Absent | Absent | Absent | Absent | Absent | Absent | Present | Present |
| After environmental test (3) | Mechanical property | | | | | | | | | |
| | Tensile strength ($kg/mm^2$) | 0.59 | 0.59 | 0.52 | 0.39 | 0.39 | 0.50 | 0.52 | 0.33 | 0.35 |
| | Elongation (%) | 90 | 80 | 90 | 50 | 110 | 80 | 80 | 10 | 10 |
| | Withstand voltage test (4) | Satisfactory | Satisfactory | Satisfactory | Satisfactory | Satisfactory | Satisfactory | Unsatisfactory | Satisfactory | Satisfactory |
| | Increase in outer diameter (%) (5) | 105 | 108 | 108 | 112 | 105 | 105 | 135 | 108 | 105 |

Note:
(1) Measurements made according to JIS C3004
(2) After application of an AC voltage across grounded water and a sample conductor submerged therein, the voltage was raised at a rate of 1 kV per minute. Voltages at which breakdown occurred were measured.
(3) After being aged at 121° C. for 168 hours according to IEEE Std. 323, each sample was irradiated with γ-rays at a dose of 200 Mrad and was exposed in steam at 150° C.
(4) Each sample was wound around a metal mandrel having an outer diameter of 220 mm. Each sample which withstood appication of a voltage of 3.25 kV was determined to be satisfactory.
(5) Ratio of the cable outer diameter after environmental testing to the original cable outer diameter According to the results shown in the above table, excellent results are obtained with wires wherein a brominated acenaphthylene and a condensate thereof are used. For example, when a comparison was made of Examples 3 and 6 and Comparative Example 1 wherein the composition and other conditions were identical except that crosslinking was performed by steam in Comparative Example 1, the wire of Comparative Example 1 did not pass the environmental tests but the wires of Examples 3 and 6 respectively passed these tests. In Comparative Examples 2 and 3 wherein commercially available flame retardants were used and the crosslinking method remained the same, the resultant wires passed the withstand voltage test. However, elongation after irradiation was significant and problems were caused such as cracking of the wire after being wound on a mandrel having a diameter equal to the wire diameter.

EXAMPLES 7–9 AND COMPARATIVE EXAMPLES 4–16

As illustrated in FIG. 1, a composition as shown in Table 3 below was extruded to a thickness of 0.8 mm on a soft copper stranded wire (1.8 mm outer diameter; 2 $mm^2$ sectional area). Continuous crosslinking was performed under the conditions shown in Table 3 to provide a flame-retardant wire insulated with a crosslinked polyethylene.

Table 3 also shows the original properties, the properties after irradiation and the properties after other environmental tests of the obtained insulated wire, in the same manner as does Table 2 above.

TABLE 3

| | | Example | | | Comparative Example | | |
|---|---|---|---|---|---|---|---|
| | | 7 | 8 | 9 | 4 | 5 | 6 |
| Composition (parts per hundred resin) | Polyethylene (1) | 100 | 100 | 100 | 100 | 100 | 100 |
| | "Nocrac-300" (2) | 0.3 | 0.3 | 0.3 | 0.3 | 0.3 | 0.3 |
| | Dicumyl peroxide | 3 | 3 | 3 | 3 | 3 | 3 |
| | Antimony trioxide | 20 | 20 | 20 | | 20 | 20 |
| | 3,5,6,8-tetrachloroacenaphthylene | 45 | | | | | |
| | Condensed brominated acenaphthylene (3) | | 45 | 30 | | 45 | |
| | Decabromodiphenyl ether | | | 15 | | | 45 |
| Heating method | | Melted salt (4) | Melted salt (4) | Melted salt (4) | Steam (5) | Steam (5) | Melted salt (4) |
| Original | Mechanical property | | | | | | |
| | Tensile strength ($kg/mm^2$) | 1.9 | 1.7 | 1.6 | 2.4 | 1.7 | 1.6 |
| | Elongation (%) | 450 | 470 | 490 | 570 | 480 | 490 |
| | Breakdown voltage (kV) | 29 | 26 | 26 | 62 | 25 | 26 |
| After irradiation | Mechanical property | | | | | | |
| | Tensile strength ($kg/mm^2$) | 1.5 | 1.5 | 1.4 | 1.2 | 1.5 | 0.9 |
| | Elongation (%) | 170 | 190 | 190 | 30 | 170 | 20 |

TABLE 3-continued

| | | Example | | | Comparative Example | | |
|---|---|---|---|---|---|---|---|
| | | 7 | 8 | 9 | 4 | 5 | 6 |
| | Breakage after winding around mandrel having diameter equal to its diameter | Absent | Absent | Absent | Present | Absent | Present |
| After environmental test | Mechanical property | | | | | | |
| | Tensile strength ($kg/mm^2$) | 1.5 | 1.5 | 1.3 | 1.1 | 1.5 | 0.6 |
| | Elongation (%) | 190 | 200 | 180 | 30 | 120 | 10 |
| | Withstand voltage test | Satisfactory | Satisfactory | Satisfactory | Satisfactory | Unsatisfactory | Satisfactory |

Note:
(1) Density: 0.925, Melt index 1.0
(2) 4,4'-thiobis(6-t-butyl-3-methylphenol)
(3) Degree of condensation: 3 to 5, Br content: 65%
(4) Temp.: 170° C., $N_2$ gas pressure: 5 $kg/cm^2$
(5) Temp.: 190° C., pressure: 12 $kg/cm^2$ It is seen from Table 3 above that chlorinated acenaphthylene and brominated acenaphthylene condensate impart excellent flame retardancy to wires for use in nuclear power stations provided crosslinking is performed in the absence of water (otherwise crosslinking produces in unsatisfactory results in the withstand voltage test).

EXAMPLES 10–12 AND COMPARATIVE EXAMPLES 7–8

Three flame-retardant wires each insulated by ethylene-propylene-diene terpolymer, which is a composition used in comparative Example 1, and having a sectional area of 8 $mm^2$ were stranded with a jute filler. The resultant cable core was covered with paper tape and the composition shown in Table 4 was extruded thereon to a thickness of 1.5 mm. Continuous crosslinking was performed under the conditions shown in Table 4 to provide a flame-retardant chlorosulfonated polyethylene jacketed cable insulated with an ethylene-propylene-diene terpolymer.

Table 4 shows the original properties, the properties after irradiation and the properties after other environmental tests of the resultant chlorosulfonated polyethylene jacketed 600 V power cable.

TABLE 4

| | | Example | | | Comparative Example | |
|---|---|---|---|---|---|---|
| | | 10 | 11 | 12 | 7 | 8 |
| Chlorosulfonated polyethylene *1 | | 100 | 100 | 100 | 100 | 100 |
| PbO | | 40 | 40 | 40 | 40 | 40 |
| Carbon | | 27 | 27 | 27 | 27 | 27 |
| Whitetex clay | | 40 | 40 | 40 | 40 | 40 |
| Aromatic oil | | 15 | 15 | 15 | 15 | 15 |
| "Kenflex A" *2 | | 20 | 20 | 20 | 20 | 20 |
| Paraffin (140° F.) | | 6 | 6 | 6 | 6 | 6 |
| "NBC" *3 | | 3 | 3 | 3 | 3 | 3 |
| MBTS *4 | | 1 | 1 | 1 | 1 | 1 |
| HVA 2 *5 | | 1 | 1 | 1 | 1 | 1 |
| Con-BACN *6 | | 30 | 10 | 10 | | 10 |
| $Sb_2O_3$ | | 10 | 5 | 5 | | 5 |
| Heating method | | Melted salt *7 | Melted salt *7 | Infrared heating *8 | Steam *9 | Steam *9 |
| Original | Mechanical property | | | | | |
| | Tensile strength ($kg/mm^2$) | 1.24 | 1.50 | 1.37 | 1.57 | 1.25 |
| | Elongation (%) | 525 | 555 | 560 | 490 | 545 |
| After irradiation | Tensile strength ($kg/mm^2$) | 1.61 | 1.88 | 1.85 | 1.83 | 1.71 |
| | Elongation (%) | 220 | 220 | 210 | 155 | 185 |
| After environmental test | Tensile strength ($kg/mm^2$) | 1.08 | 1.15 | 1.13 | 0.51 | 0.32 |
| | Elongation (%) | 210 | 200 | 200 | 55 | 95 |
| | Cracking of jacket | None | None | None | Cracking | Cracking |
| | Withstand Voltage test | satisfactory | satisfactory | satisfactory | unsatisfactory | unsatisfactory |

Note:
*1 Hypalon 40 available from Dupont
*2 Condensation product of aromatic solvent and formaldehyde
*3 Nickel dibutyldithiocarbonate
*4 Dibenzothiazyl disulfide
*5 N,N'—m-phenylenedimaleimide
*6 Condensed brominated acenaphthylene, degree of condensation: 3 to 5, Br content: 61%
*7 Temp.: 200° C., $N_2$ gas pressure: 3 $kg/cm^2$
*8 Temp.: 200° C., $N_2$ gas pressure: 2 $kg/cm^2$
*9 Temp.: 190° C., pressure: 12 $kg/cm^2$ It is seen from the table that when steam crosslinking is performed by a continuous crosslinking apparatus, the chlorosulfonated polyethylene jacket deforms to extend into the filler. Then, a cable having a circular cross-section cannot be obtained. Moreover, the cable exhibits swelling and cracking after undergoing the environmental tests.

As is evident from the above example, the method of present invention, when used to make the jacket of power cables, provides an excellent environmental resistance to them.

What is claimed is:

1. A method for manufacturing a flame-retardant insulated wire and cable for nuclear power stations, comprising the steps of extruding on a conductor or cable core to a predetermined thickness a composition consisting essentially of 100 parts by weight of a base polymer selected from the group consisting of a thermoplastic resin or a rubber which can be crosslinked by an organic peroxide-based crosslinking agent, at least 10 parts by weight of a brominated acenaphthylene or a condensate thereof, and 0.5 to 10 parts by weight of an organic peroxide, and heating the resultant wire or cable for crosslinking in the absence of water, said heating being carried out by passing the wire or cable through a molten salt bath under a pressurized nitrogen gas at a temperature higher than the decomposition temperature of the organic peroxide.

2. The method according to claim 1, wherein the melted salt bath comprises sodium nitrate, potassium nitrate and sodium nitrite.

3. The method according to claim 1, wherein the condensate of the brominated acenaphthylene has a degree of condensation of 2 to 10.

4. The method according to claim 1, wherein the brominated acenaphthylene or the condensate thereof is present in the composition in an amount of 15 to 45 parts by weight based on 100 parts by weight of the base polymer.

5. The method according to claim 1, wherein the base polymer is a thermoplastic resin selected from the group consisting of polyethylene, an ethylene-vinyl acetate copolymer, an ethylene-propylene copolymer, an ethylene-ethyl acrylate copolymer, and an ethylene-vinyl acetate-grafted vinyl chloride terpolymer.

6. The method according to claim 1, wherein the base polymer is a rubber selected from the group consisting of an ethylene-propylene-diene copolymer and an ethylene-propylene-ethylidene norbornene terpolymer.

7. The method according to claim 1, wherein the organic peroxide-based crosslinking agent is a peroxide selected from the group consisting of dicumyl peroxide, 1,3-bis(t-butyl peroxyisopropyl)benzene, and 2,5-dimethyl-2,5-di(butyl peroxy)hexyne-3,t-butyl cumyl peroxide.

8. The method according to claim 1, wherein the nitrogen gas pressure is 3 to 5 kg/cm$^2$.

9. The method according to claim 1, wherein the predetermined thickness of the composition is 0.8 to 1.5 mm.

10. A method for manufacturing a flame-retardant insulated wire and cable for nuclear power stations, comprising the steps of extruding on a conductor or cable core to a predetermined thickness a composition consisting essentially of 100 parts by weight of a base polymer selected from the group consisting of a thermoplastic resin or a rubber which can be crosslinked by an organic peroxide-based crosslinking agent, 15–45 parts by weight of a brominated acenaphthylene or a condensate thereof, and 0.5 to 10 parts by weight of an organic peroxide, and heating the resultant wire or cable for crosslinking in the absence of water, said heating being carried out by passing the wire or cable through a molten salt bath under a pressurized nitrogen gas at a pressure of 3 to 5 kg/cm$^2$ at a temperture higher than the decomposition temperature of the organic peroxide.

11. The method according to claim 10, wherein the melted salt bath comprises sodium nitrate, potassium nitrate and sodium nitrite.

12. The method according to claim 10, wherein the condensate of the brominated acenaphthylene has a degree of condensation of 2 to 10.

13. The method according to claim 10, wherein the base polymer is a thermoplastic resin selected from the group consisting of polyethylene, an ethylene-vinyl acetate copolymer, an ethylene-propylene copolymer, an ethylene-ethyl acrylate copolymer, and an ethylene-vinyl acetate-grafted vinyl chloride terpolymer.

14. The method according to claim 10, wherein the base polymer is a rubber selected from the group consisting of an ethylene-propylene-diene copolymer and an ethylene-propylene-ethylidene norbornene terpolymer.

15. The method according to claim 10, wherein the organic peroxide-based crosslinking agent is a peroxide selected from the group consisting of dicumyl peroxide, 1,3-bis(t-butyl peroxyisopropyl)benzene, and 2,5-dimethyl-2,5-di(butyl peroxy)hexyne-3,t-butyl cumyl peroxide.

16. The method according to claim 11, wherein the base polymer is a thermoplastic resin selected from the group consisting of polyethylene, an ethylene-vinyl acetate copolymer, an ethylene-propylene copolymer, an ethylene-ethyl acrylate copolymer, and an ethylene-vinyl acetate-grafted vinyl chloride terpolymer.

17. The method according to claim 16, wherein the base polymer is a rubber selected from the group consisting of an ethylene-propylene-diene copolymer and an ethylene-propylene-ethylidene norbornene terpolymer.

18. The method according to claim 17, wherein the organic peroxide-based crosslinking agent is a peroxide selected from the group consisting of dicumyl peroxide, 1,3-bis(t-butyl peroxyisopropyl)benzene, and 2,5-dimethyl-2,5-di(butyl peroxy)hexyne-3,t-butyl cumyl peroxide.

* * * * *